US005182823A

United States Patent [19]

Alsip

[11] Patent Number: 5,182,823

[45] Date of Patent: Feb. 2, 1993

[54] TOILET SEAT CLOCK APPARATUS

[76] Inventor: Ron Alsip, P.O. Box 584, Raynham, Mass. 02767

[21] Appl. No.: 783,987

[22] Filed: Oct. 29, 1991

[51] Int. Cl.[5] ..... E03D 11/00

[52] U.S. Cl. ..... 4/661; 368/10; 4/234; 4/237

[58] Field of Search ..... 4/234, 237, 661; 368/10

[56] References Cited

U.S. PATENT DOCUMENTS

| | | | |
|---|---|---|---|
| 2,087,695 | 7/1937 | Miller | 4/661 X |
| 3,783,364 | 1/1974 | Gallanis et al. | 368/10 X |
| 3,803,579 | 4/1974 | Compton | 4/661 X |
| 4,282,591 | 8/1981 | Andreuccetti | 368/10 |
| 4,944,049 | 7/1990 | Leonard | 4/597 |
| 5,036,443 | 7/1991 | Humble et al. | 4/661 X |

*Primary Examiner*—Henry J. Recla
*Assistant Examiner*—Robert M. Fetsuga
*Attorney, Agent, or Firm*—Thomas A. Kahrl

[57] ABSTRACT

The present disclosure provides a toilet seat clock for mounting on a toilet seat hingably attached to a toilet bowl having a toilet seat and a cover hingably attached to the bowl. The clock apparatus is mounted on the toilet seat in a chamber provided in a forward portion of a toilet seat, the chamber extending through the toilet seat and the clock apparatus being contained within a housing to be inserted in the chamber, the housing to be enclosed on the top by a transparent lens for viewing the display panel including the time display and being enclosed on the bottom by a base plate which is fastened by attachment members to the bottom surface of the toilet seat. A sealing member is provided for sealing the lens mounted on the upper surface of the seat for preventing the moisture from entering the chamber and contacting the clock apparatus, the clock apparatus being of conventional construction including a digital watch which is battery operated.

9 Claims, 1 Drawing Sheet

TOILET SEAT CLOCK APPARATUS

DESCRIPTION

BACKGROUND OF THE INVENTION

Modern Bathrooms commonly include a toilet, one or more wash bowls, a shower stall, or optionally a bathtub/jacuzzi and storage cabinets, typically medicine cabinets and towel racks mounted on the walls having large wall-mounted mirrors. Wall space in such bathrooms is at a premium and it is not common to have a wall-mounted clock installed in bathrooms due to lack of space, as well as for other aesthetic considerations. Furthermore, the walls of bathrooms, particularly those including shower stalls, collect condensate and items mounted thereon tend to become moisture laden creating a condition harmful to wall-mounted clocks.

More recently, it has been common to install telephones in bathrooms for the convenience of user's creating a need for time awareness.

Also modern families often include two wage earners with early morning time pressures making multiple use of the bathroom and toilet facilities a source of potential friction for family members, particularly when no clock is available in the bathroom for monitoring the time of use relative to the time of usual departure for work. It is therefore desirable to provide a new and improved clock apparatus for use in the bathroom to be suitably mounted in a new and improved manner and to be of waterproof construction.

SUMMARY OF THE INVENTION

The invention relates to an improved toilet seat clock apparatus for displaying the time of day in a bathroom environment, particularly to a user of a toilet. In particular, the invention concerns a toilet seat attached to a toilet bowl in combination with a toilet seat cover of generally flat disk-shaped construction, said toilet seat containing a clock apparatus mounted on the upper surface of the toilet seat for displaying the time of day to the occupant of the bathroom, as well as a user of the toilet. The toilet seat is hingeably attached to the toilet for movement between a generally horizontal seated position and a generally vertical open position by a hinge apparatus having a pair of hinge members which are attached to the toilet bowl. The toilet seat is of generally annular construction having a seat section provided with an elongated through-hole, a front portion and a rear portion and a generally rectangular through hole positioned adjacent the front section for accepting a clock apparatus.

The pair of hinge members includes a first hinge member provided for attaching the toilet seat to the toilet bowl, and a second hinge member provided for mounting the toilet seat cover on the toilet seat for movement of said cover between a closed position and an open position. Said toilet seat cover is of generally oval construction having a rear hinge portion and a front portion and includes a generally rectangular recess centered on a central axis of said cover, said recess having generally parallel and spaced apart relatively short side panels and a relatively long end panel in perpendicular relationship extending between the two side panels in perpendicular relationship to the longitudinal axis of the panel, the recess positioned adjacent the front section of the toilet seat when in the closed position being for providing access for viewing a clock apparatus having a watch mechanism mounted in the through-hole provided in said seat. When the toilet seat cover is in the closed position said cover is adjacent to and in parallel relationship with the toilet seat, the annular portion of said seat extends horizontally across the upper surface of the toilet bowl. The seat section of the toilet seat is provided with a smooth top surface to be used as a seat by the toilet seat user and includes a forward and a rear portion. The rectangular through-hole includes a mounting recess constructed in a rectangular fashion and extending through the seat and is adapted to form a chamber for receiving a housing containing a watch mechanism. Said mounting recess includes an upper recess for receiving a transparent lens, typically in the shape of a panel. Also a base plate is provided for attachment on the bottom surface of the seat to enclose the bottom of the clock chamber including sealing apparatus of conventional construction for sealing moisture out of the chamber and threaded fasteners for removably attaching the base plate to the bottom surface of the seat.

In the preferred embodiment, the clock apparatus comprises a conventional digital watch mechanism of known construction to those skilled in the art, which is battery operated and which includes a digital display panel of generally rectangular construction which when mounted on the chamber is visible through the lens panel, also of rectangular construction. The chamber contains four sidewalls for enclosing the generally rectangular housing section. The cover is hingeably attached to the rear portion of the seat for movement between a closed position and an open position, in the closed position the generally rectangular recess is immediately superimposed on and adjacent to the display panel of the digital watch such that time can be read with the cover closed.

In an alternate embodiment the digital watch may be energized by an internal circuit of conventional structure which is internally embedded in the seat and connected to an external power source by an insulating conductor extending through the first hinge means. The transparent lens covering is mounted in a generally rectangular shoulder portion extending around the peripheral edge of the watch chamber, a moisture proof seal being provided in around the peripheral edge of the transparent lens cover and threaded fasteners comprising the seal compound providing both the seal and a fastening means. In an alternate embodiment, the display of the numbers is adapted to reverse the direction of the display of the time such that the numbers are easily visible to a user seated on the seat or alternatively to a person standing adjacent the toilet seat and facing the toilet seat.

The invention will be described for the purposes of illustration only in connection with certain embodiments; however, it is recognized that those persons skilled in the art may make various changes, modifications, improvements and additions on the illustrated embodiments all without departing from the spirit and scope of the invention.

DETAILED DESCRIPTION OF THE PREFERRED EMBODIMENT

Figure 1:
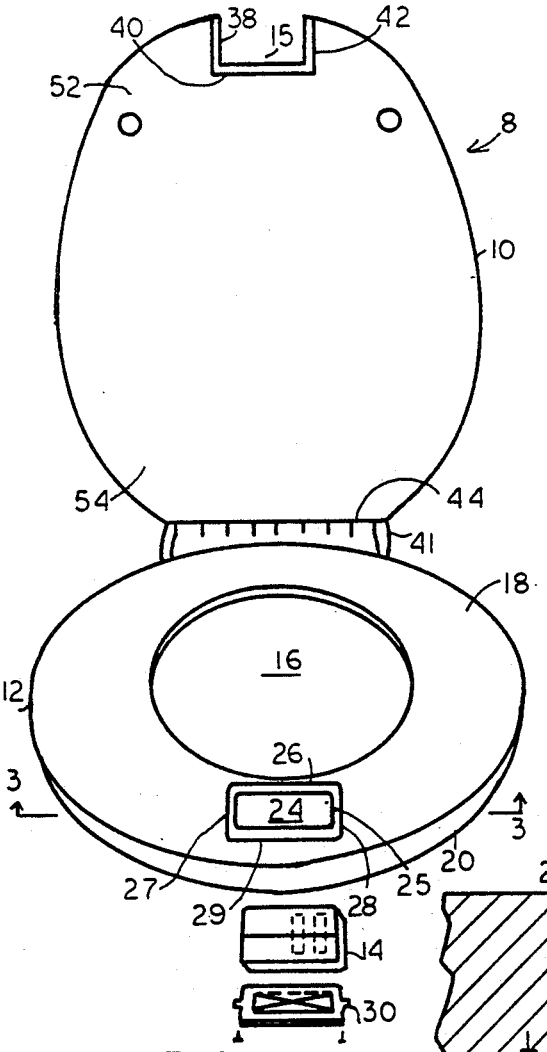
FIG. 1 is an illustrated perspective view from above of the toilet seat clock apparatus of the invention secured to the top surface of a toilet seat.
Figure 2:
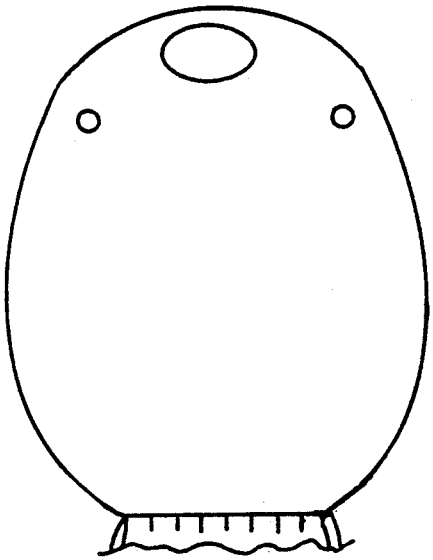
FIG. 2 is a bottom view of an alternate embodiment of invention shown in FIG. 1.
Figure 3:
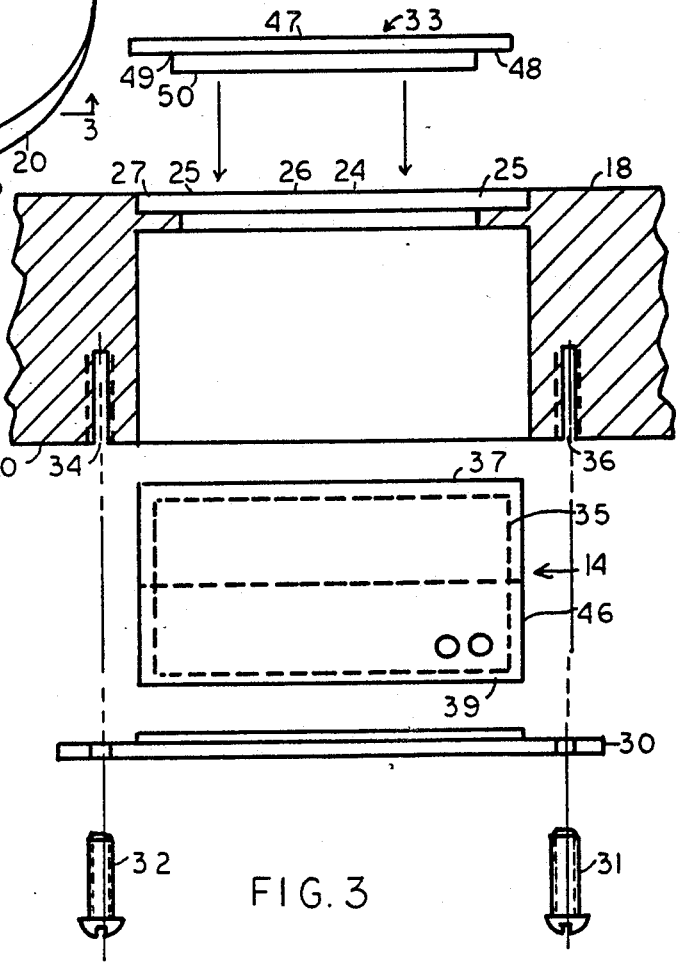
FIG. 3 is an enlarged view of the invention shown in FIG. 1. in sections with the base plate assembly and the lens assembly shown in exploded view taken along line 3—3.

With reference to the drawings, there is shown and illustrated a toilet seat 8 of the invention which includes a cover section 10 hingably attached to a seat section 12 with a clock assembly 14 mounted on the seat section. The seat section 12 and the cover section 10 are oval in configuration and may be formed of plastic or other appropriate material. As illustrated particularly in FIG. 1, the seat section 12 comprises a first through hole 16 positioned centrally, a top surface 18 having a forward and a rear portion, a bottom surface 20, a mounting recess 24, as shown in FIG. 3 constructed as a second through hole, a transparent lens cover 33 and a first hinge member 41 attached to the rear surface of said seat section. The seat section also includes a longitudinal axis. The first through hole 16 may be oval in configuration, is of comparatively large diameter and is centered along the longitudinal axis of said seat section 12. As shown in FIG. 1 in the preferred embodiment the mounting recess comprises a second through hole, which may be rectangular in configuration and comprises a first long sidewall 26, a first short sidewall 27, a second short sidewall 28, and a second long sidewall 29. The four sidewalls 26, 27, 28 and 29 are in perpendicular relationship to each other forming a rectangular shape. An integral continuous shoulder 25 extends from each of the walls 26, 27 28 and 29 being spaced below the upper surface 18 and defining a continuation of the mounting recess 24 but of lesser dimensions. The mounting recess 24 transects the longitudinal axis of the seat section 12 and is spaced from and in close proximity to the forward edge of the seat section 12. The first blind engagement aperture 34 is formed on an extension of the central major axis of the mounting recess hole 24 and in close proximity to the first sidewall 27. A second blind engagement aperture is formed on an extension of the central major access of the second through mounting hole 24 in close proximity to the second short sidewall 28, and coplanar with the first blind engagement aperture 34. The first and second blind engagement apertures 34 and 36 are set in the bottom surface 20.

The transparent lens covering 33 which is rectangular in configuration, comprises a base portion 47, a surface portion 48, an annular shoulder 49 and a seal portion 50. The rectangular seal portion 50 extends integrally from the surface portion 48 and has lesser dimensions than the base portion 47. The seal portion 50 extends centrally from the base portion 47 forming the annular shoulder 49. The annular shoulder 49 is positioned adjacent the shoulder 25 and the seal portion 50 fits within the continuation of the second through mounting hole 24 and provides a transparent lens for the clock assembly 14.

The clock assembly 14 comprises a housing section 46 for containing the clock assembly, a cover section 30, a first engagement means 31, and a second engagement means 32 for securely attaching the clock assembly to the seat and a time-keeping apparatus in the form of a digital clock 35. The housing section 46 comprises an upper portion 37 and a lower portion 39. The digital clock 35 comprises a standard rectangular battery operated clock well known in the art. The digital clock 35 is inserted into the lower portion of the housing section 46 and the upper portion 37 is then engaged with the lower portion providing a water tight encasement for the digital clock 35. The upper portion 37 of the housing section 46 must be transparent to allow the digital clock to be read. For ease of construction, both the upper and lower portions 37 and 39 may be formed of the same transparent plastic material. The housing section 46 is rectangular in configuration and fits into the interior of the second through mounting hole 24. When the housing section 46 is inserted into the second through mounting hole 24, the top portion 37 abuts the transparent lens 33. The clock cover section 30 is fastened to the bottom surface 20 by the first and second engagement means 31 and 32 securing the housing section firmly in place on the seat 12.

The cover section 10 is a conventional toilet cover and includes a forward end 52 and a hinge end 54 with the rectangular aperture 15 positioned on the forward end 52 of the cover 10. A second hinge means 44 mounted on the hinge end of the section and includes a longitudinal axis. The rectangular aperture 15 is centered on the longitudinal axis of said cover section 10 and is aligned immediately above the clock assembly 14 mounted on the seat section 12. Rectangular aperture 15 comprises a first edge 38, a second edge 40 and a third edge 42. The three edges, 38, 40 and 42 which are in perpendicular relationship to each other, are in spaced parallel relationship to sides 26, 27 and 28 respectively. The second hinge means 44 fastens to the first hinge means 41 providing a method of movably fastening the seat cover 10 for movement between an open position and a closed position to the seat section 12. Upon assembly of the digital clock, the face of the clock is positioned to show through the top of housing section 46 and transparent lens covering 33 allowing a seated position to read the time.

What is claimed is:

1. A clock apparatus for use with a toilet bowl comprising a) a toilet bowl b) a toilet seat moveably attached to the toilet bowl;

c) a cover hingably attached to the toilet seat;

d) a first hinge means for fastening the toilet seat to the toilet bowl for permitting movement between a horizontal seat position and a vertical open position;

e) a second hinge means for fastening the cover to the toilet seat for permitting movement between a horizontal covered position and a generally vertical open position;

f) a clock means for displaying the time of day and being sealably mounted in a chamber formed in the toilet seat, comprising;

i) a display panel for displaying time;

ii) a time-keeping apparatus for operating the display panel;

iii) a housing means for containing the time-keeping apparatus;

iv) a lens means for enclosing a top of the mounting chamber and comprising a transparent cover, the lens means including sealing means for sealably enclosing the chamber wherein the housing means and display panel are mounted in the chamber to be observed by a user;

v) a base plate for enclosing a base of the mounting chamber.

2. The apparatus of claim 1 wherein the housing means comprises a housing section for containing the time-keeping apparatus, the housing section including an upper portion comprising a lens and a lower portion for enclosing the time-keeping apparatus.

3. The device of claim 1 wherein the time-keeping apparatus comprises a digital watch.

4. The apparatus of claim 1 wherein the time-keeping apparatus is battery operated.

5. The apparatus of claim 4 wherein the time-keeping display may be reversed.

6. A clock apparatus and toilet seat comprising;

a) a clock means for displaying the time of day and being sealably mounted in a mounting chamber formed in the toilet seat, comprising;

i) a display panel for displaying time;

ii) a time-keeping apparatus for operating the display panel;

iii) a lens means for enclosing a top of the mounting chamber and comprising a transparent cover, the lens means including sealing means for sealably enclosing the chamber wherein the housing means ad display panel are mounted in the chamber to be observed by a user;

iv) a base plate for enclosing a base of the mounting chamber;

b) a housing means for containing the time-keeping apparatus comprising a housing section including an upper portion comprising a lens and a lower portion for enclosing the time-keeping apparatus.

7. The device of claim 6 wherein the time-keeping apparatus comprises a digital watch.

8. The apparatus of claim 6 wherein the time-keeping apparatus is battery operated.

9. The apparatus of claim 6 wherein the time-keeping display may be reversed.

* * * * *